US009511251B2

(12) United States Patent
Chang et al.

(10) Patent No.: US 9,511,251 B2
(45) Date of Patent: Dec. 6, 2016

(54) PUSH-UP TWISTING PLATE

(71) Applicants: Shuo-Hsiu Johnny Chang, Taipei (TW); Yi Ching Wang, Taipei (TW)

(72) Inventors: Shuo-Hsiu Johnny Chang, Taipei (TW); Yi Ching Wang, Taipei (TW)

( * ) Notice: Subject to any disclaimer, the term of this patent is extended or adjusted under 35 U.S.C. 154(b) by 0 days.

(21) Appl. No.: 14/799,920

(22) Filed: Jul. 15, 2015

(65) Prior Publication Data

US 2016/0016037 A1 Jan. 21, 2016

Related U.S. Application Data

(60) Provisional application No. 62/019,995, filed on Jul. 15, 2014.

(51) Int. Cl.

| | |
|---|---|
| ***A63B 23/02*** | (2006.01) |
| ***A63B 23/12*** | (2006.01) |
| ***A63B 26/00*** | (2006.01) |
| ***A63B 21/072*** | (2006.01) |
| ***A63B 21/075*** | (2006.01) |

(52) U.S. Cl.

CPC ..... *A63B 21/0722* (2015.10); *A63B 21/075* (2013.01); *A63B 21/0724* (2013.01); *A63B 21/0726* (2013.01); *A63B 23/1227* (2013.01); *A63B 23/1236* (2013.01)

(58) Field of Classification Search

CPC ..... A63B 23/1236; A63B 21/4035; A63B 21/00047; A63B 23/12; A63B 22/20; A63B 22/14; A63B 23/03541; A63B 23/1209; A63B 21/0004;A63B 2208/0219; A63B 21/068; A63B 21/00185; A63B 21/0407; A63B 21/0421; A63B 21/0435; A63B 22/0046; A63B 23/1218

USPC ..... 482/141

See application file for complete search history.

(56) References Cited

U.S. PATENT DOCUMENTS

| | | | | | |
|---|---|---|---|---|---|
| 3,063,714 | A * | 11/1962 | Krauss | A63B 22/14 | 108/139 |
| D576,693 | S * | 9/2008 | Khubani | D21/662 | |
| D579,503 | S * | 10/2008 | Hauser | D21/662 | |
| 7,553,267 | B1 * | 6/2009 | Hauser | A63B 21/00047 | 482/141 |
| 8,105,218 | B1 * | 1/2012 | Vayntraub | A63B 23/1236 | 482/141 |
| 8,827,879 | B2 * | 9/2014 | Nicholas | A63B 21/0004 | 482/131 |
| 8,876,677 | B2 * | 11/2014 | Meininger | A63B 21/00076 | 482/131 |
| 2006/0014615 | A1 * | 1/2006 | Godbold | A63B 21/00047 | 482/141 |
| 2006/0035771 | A1 * | 2/2006 | Gant | A63B 23/12 | 482/141 |

(Continued)

*Primary Examiner* — Oren Ginsberg
*Assistant Examiner* — Andrew S Lo
(74) *Attorney, Agent, or Firm* — WPAT, PC; Justin King

(57) ABSTRACT

The instant invention provides a fitness equipment for facilitating both push up and wriggling excises without occupying a large storage space. The instant invention discloses a push-up twisting plate; which is made up of two circular, rotating bases and each base has a detachable handle. The handles can be easily removed by the user by applying a rotational force on the handle and an opposing rotational force on the base. To assemble the push-up twisting plate, the user can repeat the same motion, but in reverse.

5 Claims, 5 Drawing Sheets

(56) References Cited

U.S. PATENT DOCUMENTS

| | | | | |
|---|---|---|---|---|
| 2007/0184951 | A1* | 8/2007 | James | A63B 21/4035 482/141 |
| 2010/0261590 | A1* | 10/2010 | Fares | A63B 21/00047 482/131 |
| 2010/0279833 | A1* | 11/2010 | Gant | A63B 21/00047 482/141 |
| 2010/0317496 | A1* | 12/2010 | Abranchess | A63B 21/0004 482/141 |
| 2011/0065555 | A1* | 3/2011 | Moskowich | A63B 23/12 482/141 |
| 2012/0083396 | A1* | 4/2012 | Aquino | A63B 21/0004 482/131 |
| 2014/0162857 | A1* | 6/2014 | Shade | A63B 23/1236 482/141 |
| 2014/0194265 | A1* | 7/2014 | Torres | A63B 23/1236 482/141 |

* cited by examiner

PUSH-UP TWISTING PLATE

CROSS REFERENCE TO RELATED PATENT APPLICATION

This patent application claims the priority of the U.S. provisional application 62/019,995 filed on Jul. 15, 2014

FIELD OF THE INVENTION

The utility model relates to a fitness equipment, especially a push-up twisting plate with a detachable handle.

BACKGROUND OF THE INVENTION

With the pursuit of quality of life, more and more people start to exercise more. Among different types of exercises, both push-ups and wriggling are gaining popularity.

Number of fitness equipments are available in the market to facilitate these exercise; such as push-ups bracket, twisting plate and so on. Consumer products for enhancing exercise regimens are becoming increasingly complex or difficult to use. The conventional the push-ups bracket including an integrated handle portion and a chassis part. This presents a problem for people who exercise at home where storage and maintenance of complex equipment can be difficult. Not only it takes a considerable space for storage, it only provides one single exercise function. Users will need to use a different fitness equipment for wriggling. Therefore, it is an objective of the invention to provide a simple exercise apparatus that a user can assemble and disassemble easily.

SUMMARY OF THE INVENTION

The instant invention provides a fitness equipment for facilitating both push up and wriggling excises without occupying a large storage space.

The present invention relates to exercise apparatus, and more specifically to a combo push-up twisting plate with a removable handle.

The instant invention discloses a push-up twisting plate; which is made up of two circular, rotating bases and each base has a detachable handle. The handles can be easily removed by the user by applying a rotational force on the handle and an opposing rotational force on the base. To assemble the push-up twisting plate, the user can repeat the same motion, but in reverse.

BRIEF DESCRIPTION OF THE DRAWINGS

FIG. 6 shows a section of a top layer the base where the handle is attaching to.

DETAILED DESCRIPTION OF THE PREFERRED EMBODIMENT

The instant invention aims to provide a fitness equipment for both push-up and wriggling, and occupying minimum storage space.

The instant invention includes a handle and a chassis, which the chassis includes a top layer, a middle layer with ball bearing, and a bottom layer.

Figure 1:
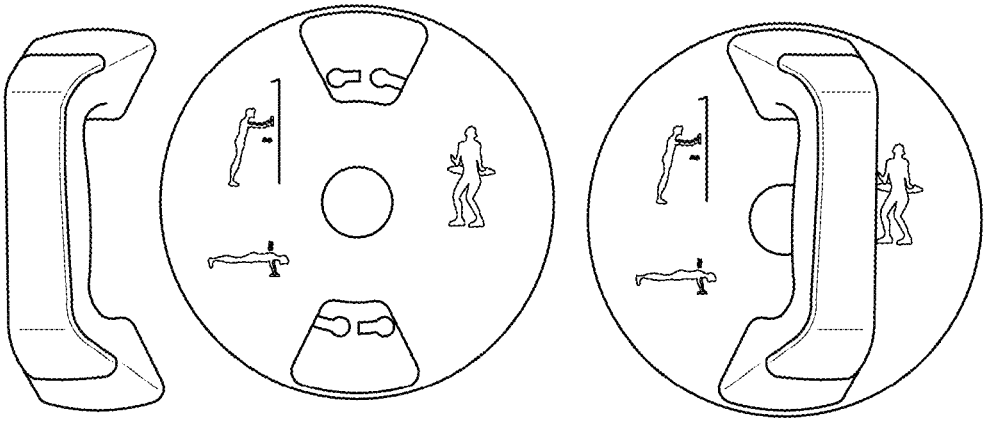
FIG. 1 shows a top-down view of the push-up twisting plate. The rotating base on the left has had its detachable handle removed.
Figure 2:
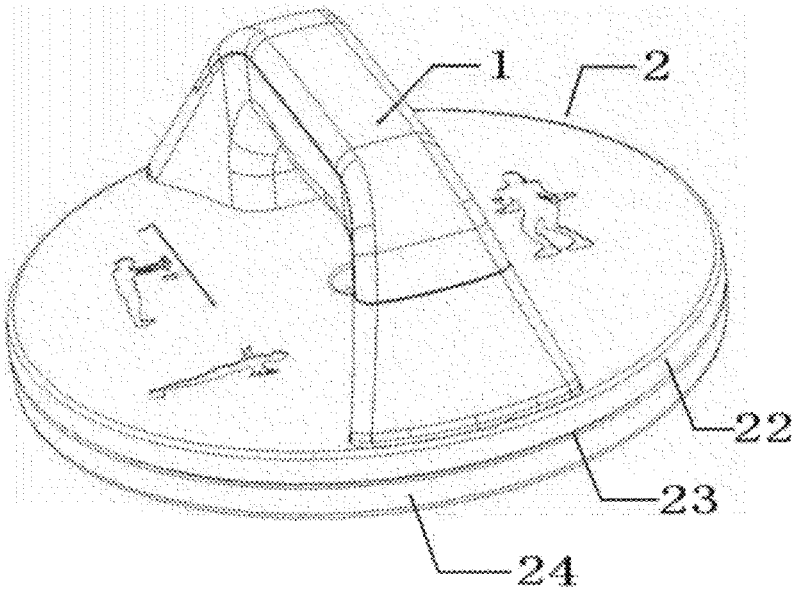
FIG. 2 is a schematic side view illustrating the push-up twisting plate with handle attached.
Figure 3:
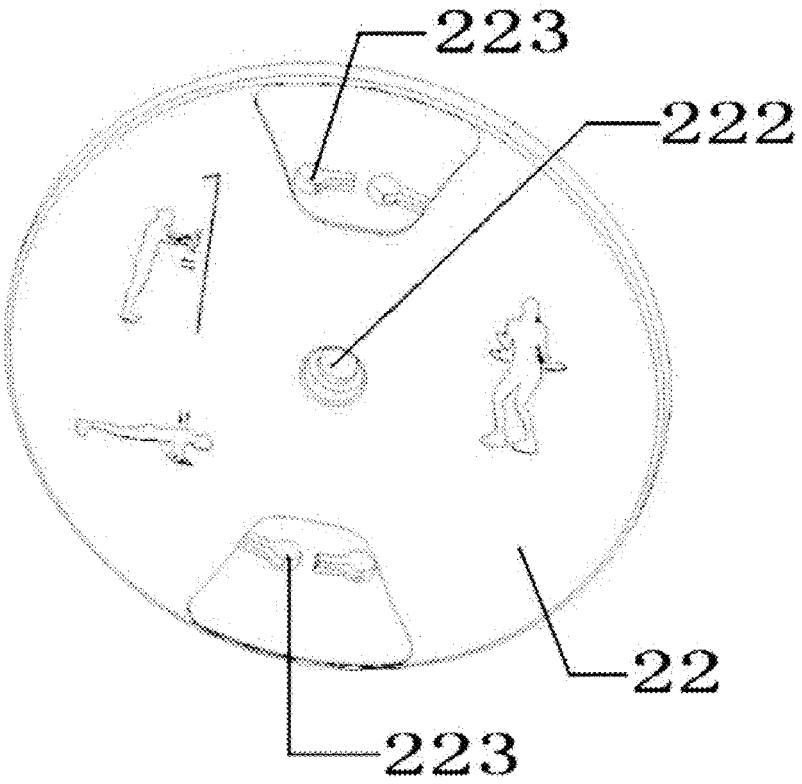
FIG. 3 is a schematic side view illustrating the push-up twisting plate with handle detached.

As shown in FIGS. 1-3, the instant invention includes a handle 1 and chassis 2; the chassis 2 further includes a top layer 22, a middle layer 23, and a bottom layer 24. The handle 1 attached into the connecting ports 223.

Figure 4:
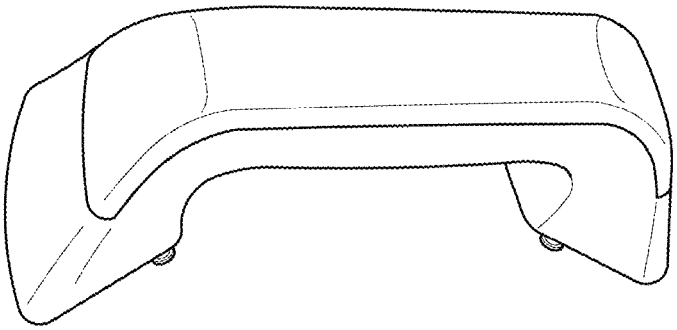
FIG. 4 shows a top view of the handle detached from the base.
Figure 5:
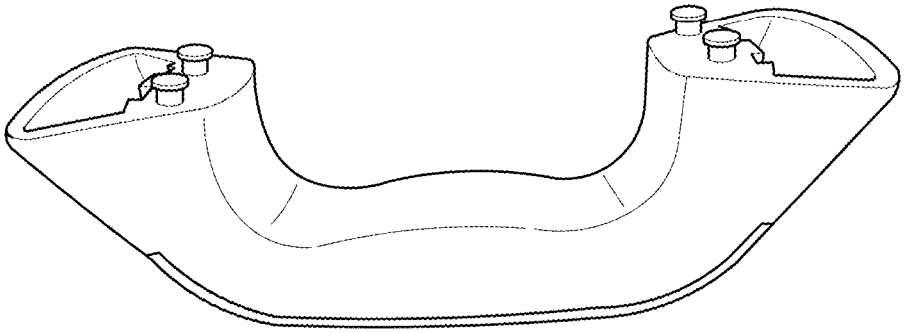
FIG. 5 shows a bottom view of the handle detached from the base.
Figure 6:
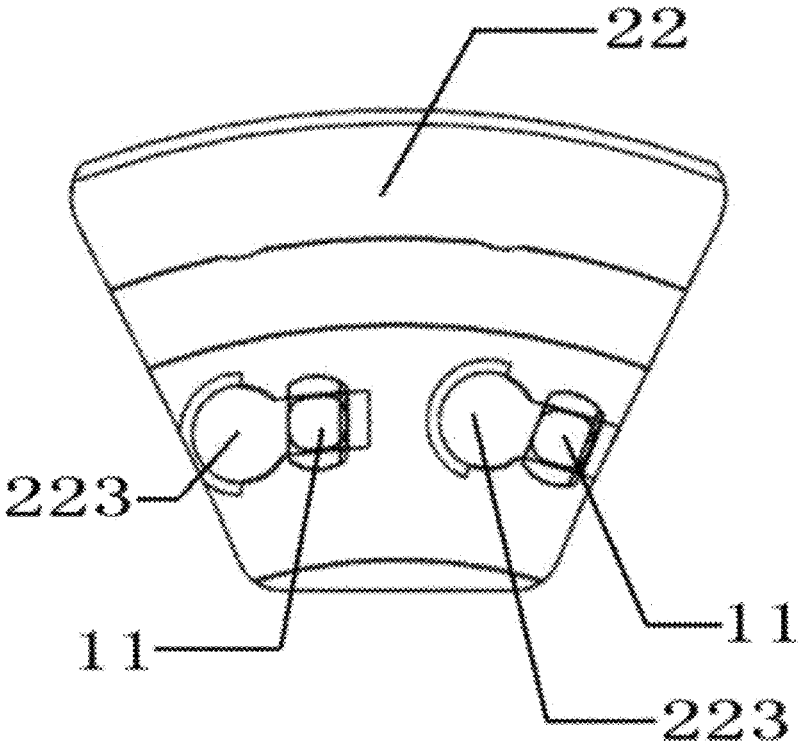

As shown in FIGS. 4-5, the handle 1 has 2 pairs of connecting legs for connecting with the connecting ports 223. Each of connecting ports 223 consists of a slot with a snap 11, the slot further includes a narrow portion and a wide portion. Each of the connecting legs consists of a large anchoring head and a supporting portion. When attach the handle onto the chassis, the connecting legs are inserted into the slot's wide portion and then slide along the slot into the narrow portion and connected with the snap 11.

Figure 7:
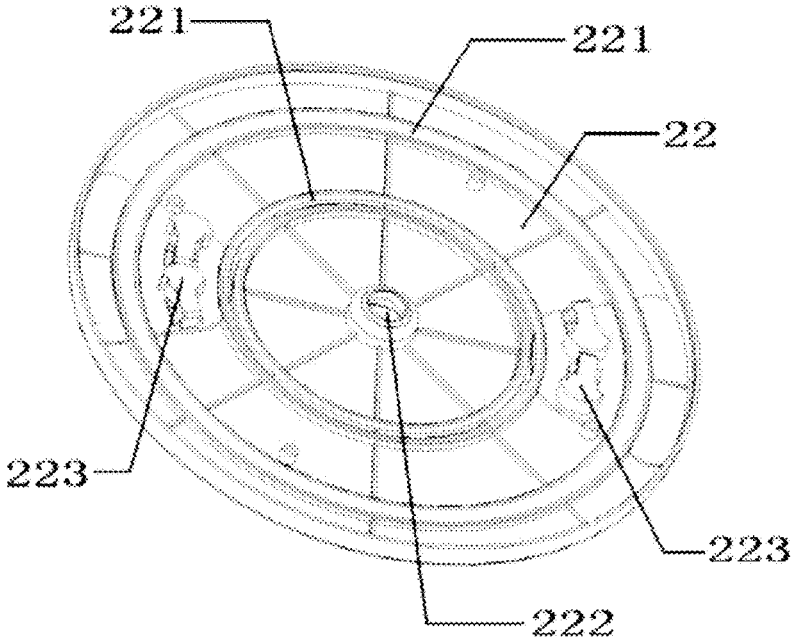
FIG. 7 shows a schematic view of the top layer of the base.
Figure 8:
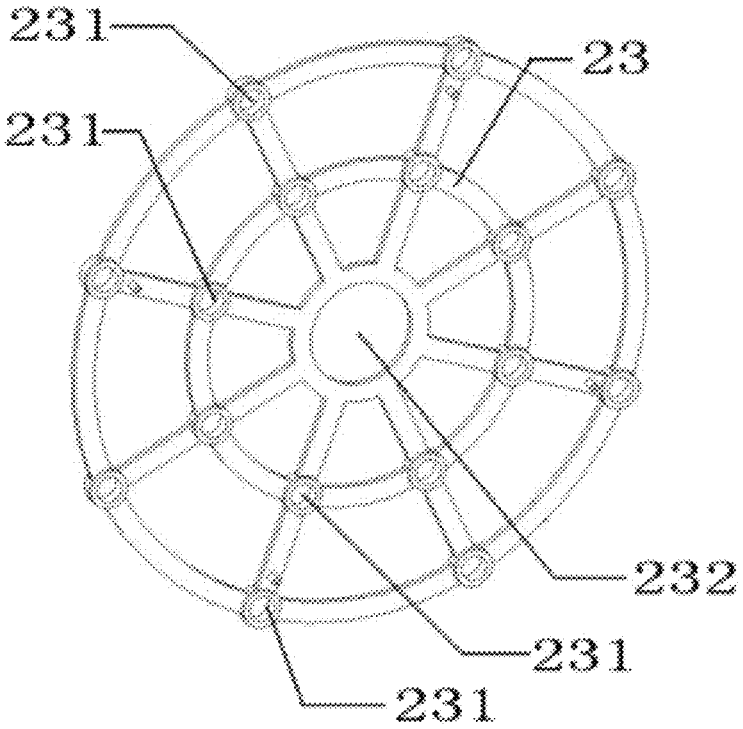
FIG. 8 shows a schematic view of a middle layer of the base.
Figure 9:
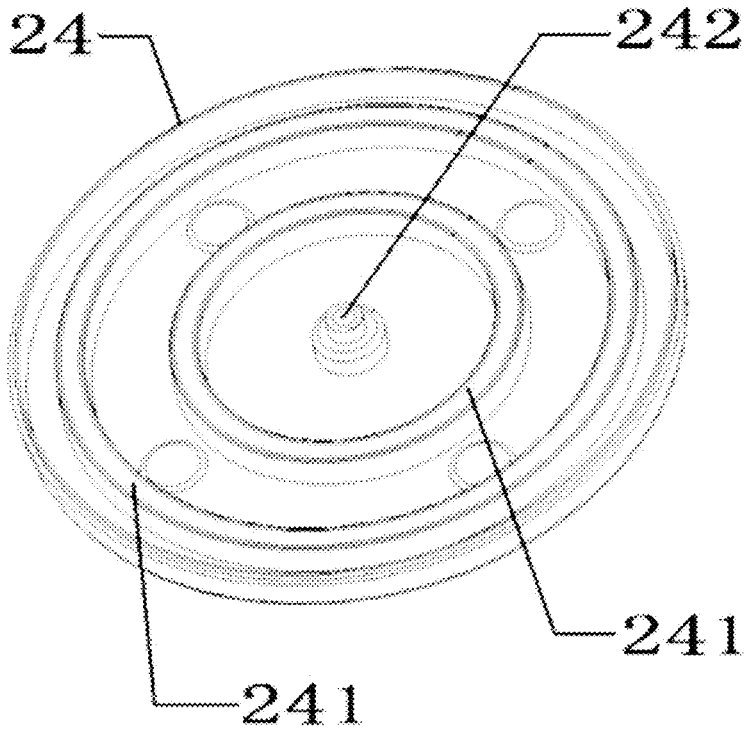
FIG. 9 shows a schematic view of a bottom layer of the base.

As shown in FIG. 7, the top layer 22 has a first annular track 221 and a connecting hole or a jack 222, and as shown in FIG. 9, the bottom layer 24 has a second annular track 241 and a connecting pole 242. The size of the connecting pole 242 is snuggly fitted into the connecting hole 222. As shown in FIG. 8, the middle layer 23 has a connection hole 232 and a plurality of ball grooves 231 for accommodating track balls. The track balls (not shown) are placed in the ball grooves 231 and sandwiched between the first track 221 and the second track 241.

The connecting holes 222, 232, and pole 242 are concentric. The three layers are attached together by stacking up them together, and pushing the connecting pole 242 through the connecting hole 232 and then snapping into the connecting hole 212. Once three layers are connected, the top layer 22 and the bottom layer 24 will be able to relatively rotate via the track balls in the middle layer 23.

In a preferred embodiment, the ball grooves 231 are arranged in two concentric rings, and the corresponding first annular and second annular ball tracks 221 and ball track 241 is also arranged with two concentric annular tracks.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A push-up twisting plate with a detachable handle, comprising:

said detachable handle, comprising:

a handle bar;

a supporting portion; and an anchoring portion comprising a connecting leg;

wherein said anchoring portion connects to said handle bar via said supporting portion; and a chassis, comprising:

a top layer comprising:

a top center opening; and a connecting port, wherein said connecting port comprises a wide portion and a narrow portion;

a middle layer comprising:

a middle center opening, an inner ball bearing ring; and an outer ball bearing ring; and a bottom layer comprising:

a bottom center protruding structure;

an inner track corresponding to said inner ball bearing ring; and an outer track corresponding to said outer ball bearing ring;

wherein said bottom center protruding structure protrudes through said middle center opening and said top center opening, and said connecting port is positioned above and between said outer ball bearing ring and said inner ball bearing ring; and wherein said anchoring portion attaches into said connecting port when said detachable handle is attaching to said top layer, wherein said connecting leg is inserted into said wide portion, and then slides into and locked at said narrow portion.

2. The push-up twisting plate with said detachable handle according to claim 1, wherein said top layer further comprising a first annular track and a center jack.

3. The push-up twisting plate with said detachable handle according to claim 1, wherein said bottom layer further comprising a second annular track and a center pole.

4. The push-up twisting plate with said detachable handle according to claim 3, wherein said middle layer further comprising a ball groove for accommodating track ball.

5. The push-up twisting plate with said detachable handle according to claim 4, wherein said top layer and said bottom layer are sandwiching said middle layer, and said top layer and said bottom layer are rotating via over said track ball when said track ball rolls in said second annular track.

* * * * *